US005193816A

United States Patent [19]

Ahmed et al.

[11] Patent Number: 5,193,816

[45] Date of Patent: Mar. 16, 1993

[54] PROJECTILE AND TARGET IDENTIFYING APPARATUS

[75] Inventors: Ejaz A. Ahmed, Edison; Joseph L. La Mura, West Caldwell, both of N.J.

[73] Assignee: Joanell Laboratories, Inc., Livingston, N.J.

[21] Appl. No.: 861,469

[22] Filed: Apr. 1, 1992

[51] Int. Cl.[5] ..... F41J 5/044

[52] U.S. Cl. ..... 273/373

[58] Field of Search ..... 273/373

[56] References Cited

U.S. PATENT DOCUMENTS

| | | | |
|---|---|---|---|
| 2,749,124 | 4/1953 | Ream | 273/373 |
| 2,749,125 | 6/1956 | Ream | 273/373 |
| 3,004,763 | 10/1961 | Knapp | 273/373 |
| 3,112,110 | 11/1963 | Schulman | 273/373 |
| 3,401,939 | 9/1968 | La Mura | 273/373 |
| 3,602,510 | 8/1971 | Knippel et al. | 273/373 X |
| 3,727,069 | 4/1973 | Crittenden, Jr. et al. | 273/102.2 |
| 4,240,640 | 12/1980 | La Mura | 273/373 |
| 4,828,269 | 5/1989 | Tessel | 273/373 |
| 4,953,875 | 9/1990 | Sudit | 273/373 |

*Primary Examiner*—William H. Grieb
*Attorney, Agent, or Firm*—William Squire

[57] ABSTRACT

A plurality of targets comprise two spaced metal screens secured in electrical isolation. A voltage is applied to the screens such that when the screens are shorted by a penetrating metal projectile, a pulse is produced having a pulse duration representing a particular type of projectile according to the length of the projectile. A logic circuit including a counter produces a count signal representing the pulse duration and applies this count signal to a CPU which compares the count signal to stored time intervals to produce a projectile identifying signal which is applied to a LCD display for describing the type of projectile hitting the target. A target signal generator generates a signal representing any one of the targets hit in response to a hit on that one target and supplies that signal to the CPU which generates a display signal identifying the target descriptively.

20 Claims, 3 Drawing Sheets

DISPLAY
11
ENGINE COMPARTMENT

DISPLAY
11
105 mm
10
PROJECTILE SIGNAL AND TARGET SIGNAL GENERATOR
14
PROJECTILE AND TARGET IDENTIFYING SIGNAL GENERATOR
15
DISPLAY
11
CABLE ASSY
13

12
A
B
C
D
3
4
+V
16
POWER SUPPLY 1
2
2'
3
4
5
L
T1

5
2
2'
4
3
T2

T
T1
T2
T'
T2'
T''
T2''
T'''
T2'''
30 CAL
50 CAL
S1
S2
S3
S4
105mm
120mm
L1
L2
L3
L4

PROJECTILE AND TARGET IDENTIFYING APPARATUS

FIELD OF THE INVENTION

This invention relates to projectile and target identifying apparatus.

BACKGROUND OF THE INVENTION

Projectile hit scorers comprising target hit indicators and projectile identifiers are known. These devices are used to score a hit on a target by various types of weapons and to identify hits of projectiles of different calibers. For example, U.S. Pat. No. 3,602,510 discloses a projectile hit scorer and detector comprising a conductive layer and a non-conductive layer ahead of the conductive layer. An impacting projectile on the non-conductive layer loses its kinetic energy causing electrons to flow into and out of the conductive layer through a load circuit. It is indicated that as a projectile passes through the air it accumulates a charge. When the projectile impacts a voltage is generated. The resultant pulse amplitude and duration is indicative of the energy in the projectile and permit identification of hits by projectiles of different caliber. The measurement of energy requires both amplitude and duration to be measured requiring an oscilloscope or, in the alternative a voltmeter and counter. The measurement of energy is somewhat cumbersome. Further, the patent states that the target signal generation awaits further test verification and experimentation, indicating that the disclosed method of projectile hit scoring is subject to possible error.

U.S. Pat. No. 3,727,069 discloses a target measurement system for precise projectile location. This system uses collimated light beams in a grid network to identify target location and diameter of a penetrating projectile which intercepts the beams. This system is complex and costly. Further, if a projectile misses the target area and impacts the light sources the target could be disabled. This is not desirable in a military training application where, for example, the target may be located 3000 feet or more from the projectile firing apparatus, and subject, therefore to large impact locating errors.

Other systems are known for recording hits on targets as shown for example in U.S. Pat. Nos. 3,112,110; 3,004,763; 2,749,124; 2,749,125; 4,240,640 and 3,401,939, the latter two patents being commonly owned with the present invention and incorporated by reference herein. The mere recording of hits on a target, however, is not as desirable as identifying the type of projectile making the hit and also, identifying a given target among an array of targets.

The present inventors recognize a need for a low cost, simple apparatus for both identifying projectiles hitting a target by projectile type and also for distinguishing between targets hit. The target must also survive hits throughout the target without impairing the target's ability to function so as to withstand numerous hits from a variety of types of projectiles. The projectile types must be identified repeatedly and reliably with a high degree of accuracy. Further, the identification must be made simply so that unskilled persons can readily read the results quickly and accurately.

SUMMARY OF THE INVENTION

A projectile identifying apparatus according to the present invention for identifying different types of projectiles according to their lengths, each type having a different length, comprises a pair of conductive planar layers in spaced electrical isolation arranged parallel to each other a given distance smaller than the shortest of the lengths. Circuit means are responsive to the conductive connection of the layers for generating a signal manifesting the time duration a projectile penetrating the layers is ohmically engaged with the layers. Means are responsive to the signal for identifying the type of projectile penetrating the layers in accordance with the time duration.

The apparatus, in a further feature, includes a plurality of targets, the apparatus including target signal generating means responsive to the penetration of a target by a projectile for generating a target signal manifesting that target penetrated, the identifying means including means responsive to the target signal for generating a target identifying signal for display of target description.

IN THE DRAWING:

FIG. 1 is a schematic diagram of an apparatus according to one embodiment of the present invention;

FIGS. 2*a* and 2*b* illustrate a projectile penetrating a target at two stages of penetration to illustrate certain principles of the present invention;

FIGS. 3*a* and 3*b* illustrate a representative display of respective target and projectile identifying criteria;

DETAILED DESCRIPTION OF THE PREFERRED EMBODIMENT

Figures 1, 2A, 2B, 3A, 3B, 4:
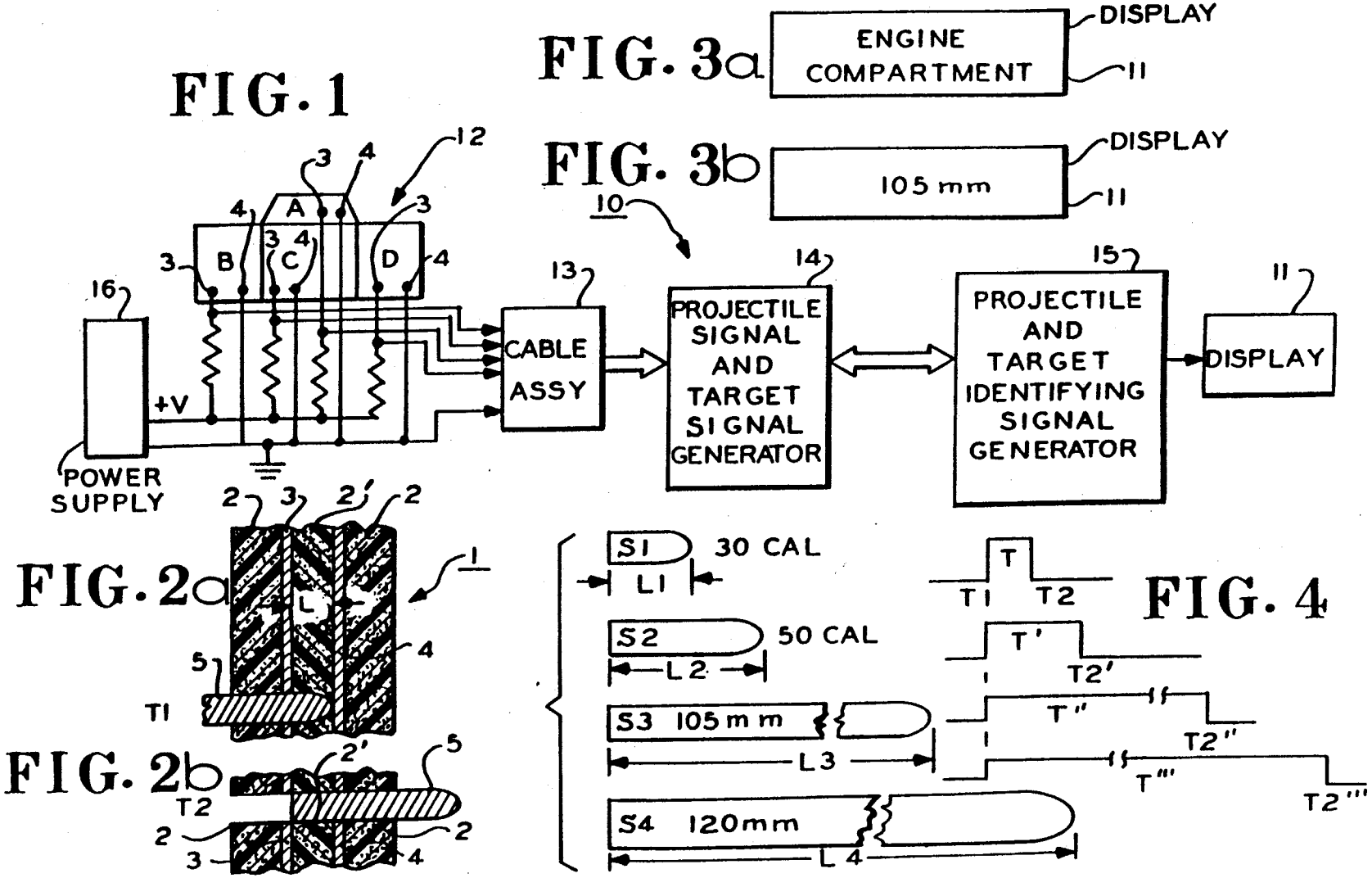
FIG. 4 illustrates exemplary projectiles of different types and corresponding signals generated when penetrating the target of FIGS. 2*a* and 2*b*.

In FIGS. 2*a* and 2*b*, target 1 is a laminated structure which comprises three planar sheets 2 and 2' of electrically insulating material and two like metal screens 3 and 4. The central sheet 2' may comprise small celled foamed polypropylene and a polymer resin coated, fiberglass web laminated on both sides of the sheet 2'. The screens 3 and 4 may be a polymer resin coated, brittle, calendered aluminum woven wire screen. This structure, for example, is described more fully in U.S. Pat. No. 4,240,640 incorporated by reference herein. This structure permits penetrating projectiles to pass therethrough without significant material foldback, tearing, cracking and shredding, especially large projectiles, e.g., 105 mm tank cannon projectiles.

Projectile 5 in FIG. 2*a* is shown penetrating the target 1 to a point where its front tip has just impacted and electrically contacted screen 4. The projectile is of sufficient length so as to also be in ohmic contact with screen 3. The projectile being made of metal provides an electrical short circuit between the screens 3 and 4 at this time. As the projectile continues through the target 1, it reaches a point at which it is still in contact with screen 3 but is about to disengage from screen 3 as it proceeds in the forward direction to the right in the drawing figure. As a result it should be clear that projectiles of differing lengths will all short the screens 3 and 4 only on the condition that the shortest projectile is at least as long as the spacing L between the screens, and preferably somewhat longer to allow for slight differences in manufacturing tolerances of the different structures.

If a positive voltage, e.g., 5 volts, were impressed across the screens 3 and 4 such that screen 3 is at a high potential and screen 4 is at a low potential, e.g., ground, the potential on screen 3 would then go low for as long as the projectile electrically connects the screens creating a pulse. In FIG. 4, four different projectile types S1, S2, S3 and S4 are illustrated, 30 caliber, 50 caliber, 105 mm and 120 mm, respectively. The 30 caliber projectile produces a pulse of time duration T. Each of the other projectiles produces increasingly longer time duration pulses T', T'' and T'''. It can be shown that there is no significant difference in the initial velocity of the projectiles as a result of penetrating the target. The length L1 of a 30 caliber unit is 0.0306 meters. The corresponding lengths L2, L3 and L4 of the respective 50 caliber, 105 mm and 120 mm projectiles are 0.0582 meters, 0.27 meters and 0.453 meters. These lengths are sufficiently different to allow distinguishing identifying signals to be generated based on time duration alone among the different projectiles.

For a 30 caliber projectile S1 assume a velocity of 915 meters per second (m/s). Assume a distance L between screens 3 and 4 of 0.0254 m. It can be shown that the time duration of this projectile in contact with the screens is 5.683 microseconds (us). Similarly, projectiles S2, S3 and S4 at respective velocities of 915 m/s, 1,539 m/s and 1064 m/s produce significantly different screen contact pulses of 35.85 us, 158.93 us and 401.53 us, respectively. These time durations are sufficiently different to produce reliable detection of each type of projectile.

In FIG. 1, apparatus 10, detects the time duration of the pulses produced by the different projectiles and generates a display on display 11 providing a graphic indication of the projectile type and also which target was hit by a graphic description of the target. Target 12 comprises four electrically isolated sections, A, B, C and D representing a tank, for example. Section A represents the tank turret, B represents the engine compartment at the rear, C represents the pilot compartment centrally located and D represents the forward section. Display 11 in FIG. 3*a* would give a description of the Engine Compartment if that is the section that was hit. Subsequently, display 11 in FIG. 3*b* gives a description of the projectile that made that hit, e.g., 105 mm. The display 11 may be a LCD (liquid crystal) or a video monitor. In this case the displays of target and projectile are sequential, but in the alternative may be simultaneous.

The sections A, B, C and D while shown in close proximity, are formed of separate, spaced targets so that each target is electrically isolated from the others, i.e., the screens 3 and 4 are separate from each other. Each of the sections A, B, C and D are connected by a cable assembly 13 to a remotely situated detection circuit comprising a projectile signal and target signal generator 14 which supplies target and projectile signals to projectile and target identifying signal generator 15. Generator 15 generates the identifying signals supplied to display 11 for display as explained above. A power supply 16 supplies a voltage +V, e.g., 5 volts DC, to each of screens 3 of the different targets through a corresponding resistance. Screens 4 are connected to the power supply return, e.g., ground. Each of the screens 3 and 4 of the targets are connected by cable assembly 13 to generator 14 which generates the appropriate signals manifesting a given hit target and the type of projectile involved.

Figure 5:
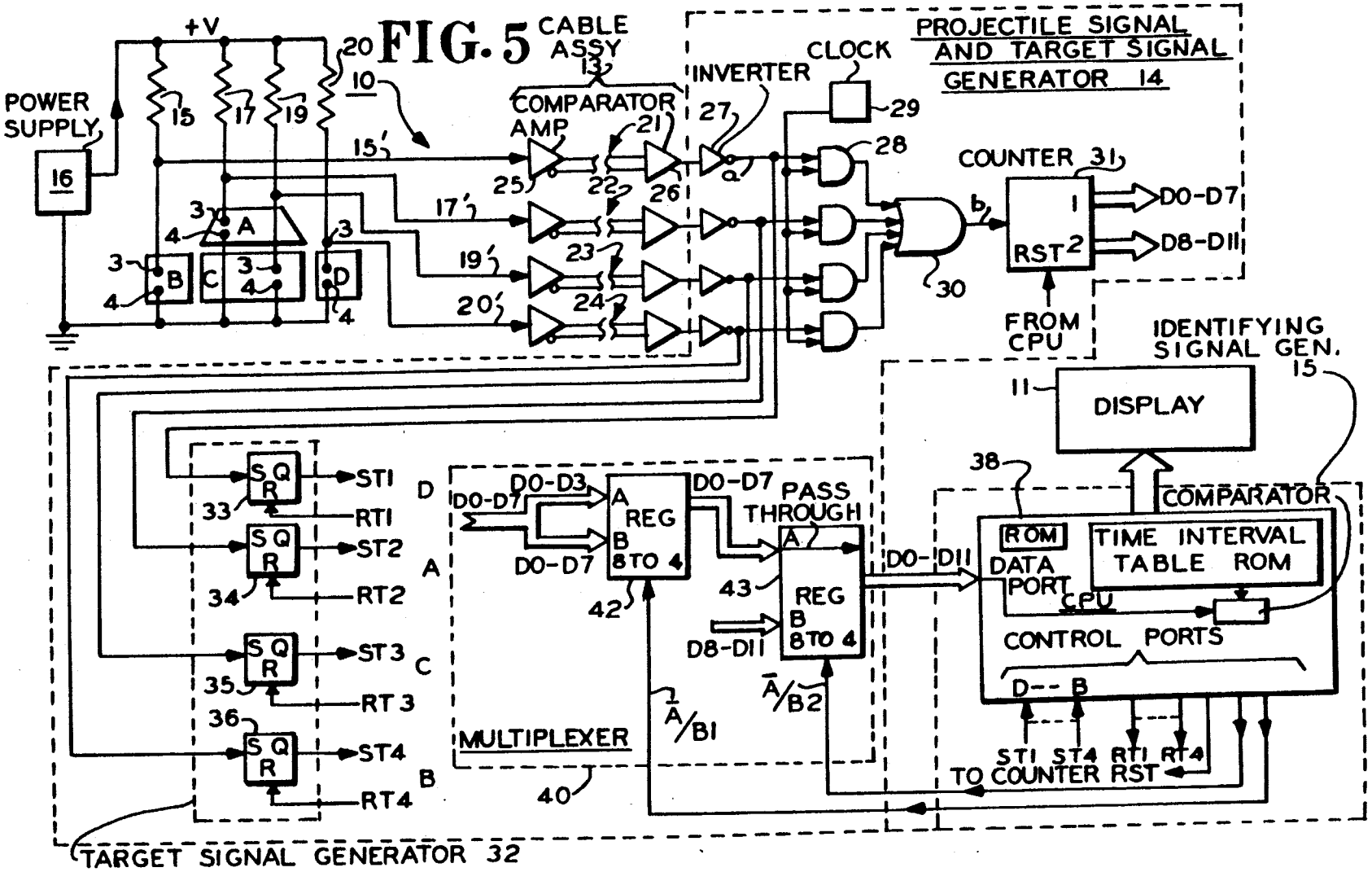
FIG. 5 is a more detailed circuit diagram of the embodiment of FIG. 1.

In FIG. 5, power supply 16 preferably comprises 5 volts DC. The return to the power supply is connected to system ground 16' and screens 4 of each target A, B, C and D. The high output +V is connected to screen 3 of target B via resistance 15, screen 3 of target A via resistance 17, screen 3 of target C via resistance 19 and screen 3 of target D via resistance 20. These resistances may be, for example, 10K ohms each. There are four conductors 15', 17', 19' and 20' each of which connect a respective different junction between the resistances 15, 17, 19 and 20 and the targets D, B, A and C to an amplifier 25 of respective corresponding subcables 21, 22, 23 and 24 of cable assembly 13. Whenever a direct connection is made between a screen 3 and a screen 4 of a target, as for example when a projectile penetrates the screens, the voltage signal supplied to a corresponding amplifier goes from a high value to a low value by the connection to system ground 16' by the penetrating projectile.

The subcables 21–24 are identical and only subcable 21 will be described as being representative. Subcable 21 comprises an amplifier 25 having an inverting output and a non-inverting output. These outputs are supplied to a comparator 26 which in accordance with which input is high and which input is low will produce an output signal having either a logic high or low value. For example, conductor 15' is normally high. If target B is penetrated by a projectile the signal on conductor 15' will go low. Therefore, the non-inverting output of amplifier 25 of cable 21 is normally high and goes low in the presence of a projectile impacting on its corresponding target B. Therefore, the output of comparator 26 is normally high except when a projectile is indicated at which time it then goes low. The comparator output is supplied to an inverter 27 to produce projectile signal a, which is normally low except when indicating the presence of a projectile hit on target B when it goes high.

Figure 6:
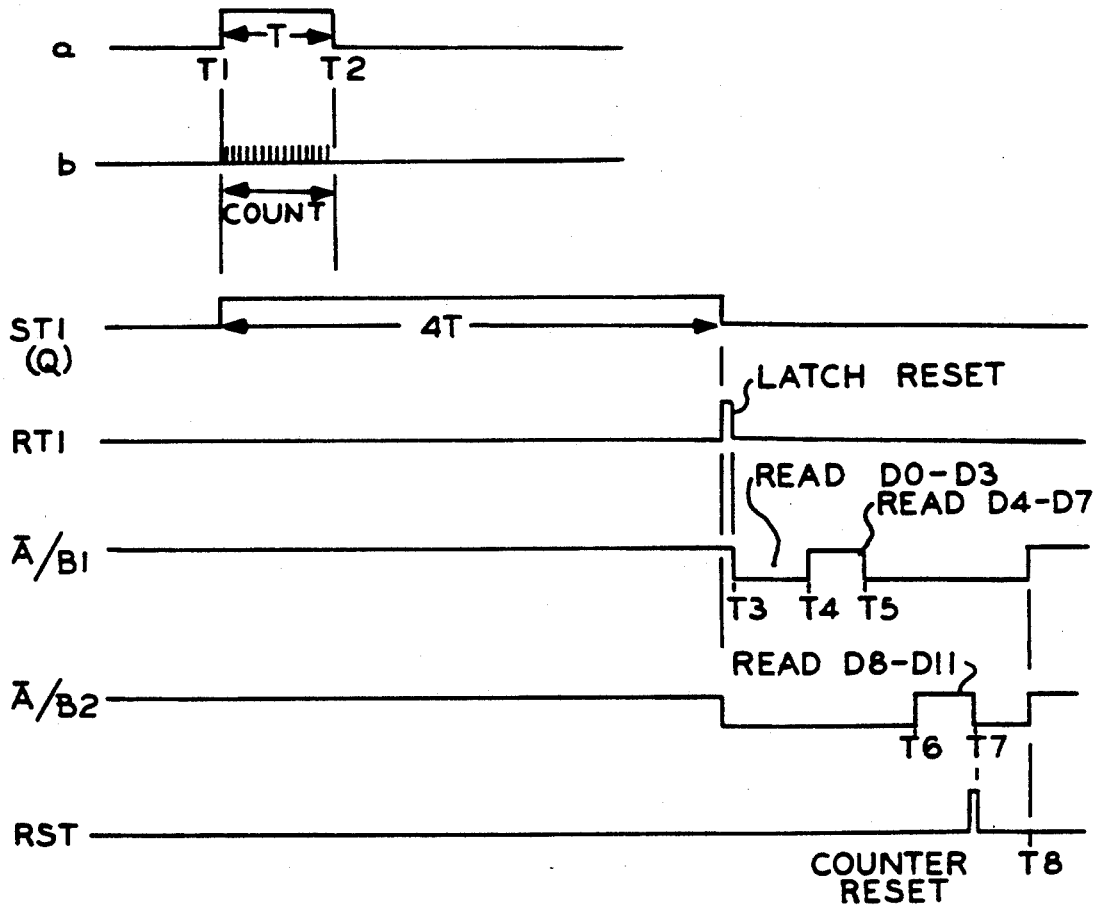
FIG. 6 is a timing diagram of certain waveforms produced by the circuit of FIG. 5.

The output Of inverter 27 is applied as one input to an AND gate 28. The other input of gate 28 is supplied by clock 29, which may have a frequency in the range of 8–10 mHz. In similar fashion an AND gate is coupled to the clock 29 and output of a corresponding inverter of each subcable assembly 22–24. An OR gate 30 supplies the AND gate outputs as clock count signal b, FIG. 6, to counter 31. Counter 31 may have a 12 bit output producing a first output signal of 8 bits D0–D7 and a second output of 4 bits D8–D11. The count manifested by bits D0–D11 represents the time duration of signal b from gate 30. This count thus manifests the identity of one of projectiles S1–S4, FIG. 4.

The output signal a of each subcable 21–24 is also applied to target signal generator 32 which comprises a set of four set-reset flip flops 33–36 each of which corresponds to a different subcable 21–24. The flip-flops latch the signal a applied to the set input to produce signal ST1 at the Q flip-flop output. Signal ST1 has a duration 4T preferably of about four times the duration T of signal a. This provides a delay suitable for reading the counts of the output of counter 31 by CPU 38 in a manner to be described. The counter 31 is reset by a signal RST at the end of a hit cycle and the flip-flops 33–36 are reset by respective signals RT1–RT4 generated by CPU 38.

The output count signals D0–D11 are applied to multiplexer 40 which reduces the 12 bit counter output signal to an eight bit signal to be applied to the data input port of CPU 38. The reason for this is that the CPU is an Intel 8088 microprocessor. A minimum of 12 bits needs to be generated to allow for the longest time T of the 120 mm projectile at the clock rate of at least 8 mHz. This clock rate is needed to provide the desired resolution for the shortest projectile. The Intel 8088 is of lowest cost for the desired functions of the circuit.

The counter 31 output is divided into three signals D0–D3, D4–D7 and D8–D11 of four bits each. The D0–D3 signal is applied to the A input of an 8 to 4 register 42 and the D4–D7 signal is applied to the B input of register 42. The D7–D11 signal is applied to the B input of 8 to 4 register 43. The A input of register 43 is a pass through for passing the outputs D0–D3 and D4–D7 of register 42 sequentially, but directly to the data input port of CPU 38. The B input of register 43 receives the D7–D11 signal from counter 31 and applies this signal to the CPU sequentially relative to the outputs of register 42.

CPU 38 includes a programmed ROM which causes the signals RT1–RT4 to be generated at the end of respective signals ST1–ST4 whose time duration is determined by the program via a looping sequence initiated by the ST1–ST4 signals applied to the CPU control ports. At the end of these ST1–4 periods the CPU generates the flip-flop reset signals RT1–RT4, see FIG. 6, setting Q low. At time T3, the CPU generates a logic low signal $\overline{A}$/B1, which normally is high, for a time duration until time T4 is reached. This low signal is applied to register 42 for outputting signal D0–D3 to register 43 and thence to CPU 38. Signal $\overline{A}$/B1 then goes high in the period T4 to T5 at which time register 42 outputs signal D4–D7 to register 43 and thence to CPU 38. During time T3 T5, signal $\overline{A}$/B2 has gone low and stays low in this period disabling register 43 from outputting the signal on input B while enabling input A to pass through the received D0–D7 signals. In period T6–T7 after period T3–T5 has elapsed, signal $\overline{A}$/B2 goes high outputting signal D8–D11 to the CPU data input port. Four of the 8 bits outputted are blocked at this time and are zero. At time T7 the CPU generates the counter reset signal RST for resetting the counter to zero to receive the next projectile hit count. The entire cycle terminating at time T8, when the CPU resets the system, may be about 15 milliseconds. Thereafter the system waits for the next hit and the cycle repeats.

The stored program in the CPU cause a programmed comparison of the received counts to the counts stored in a table in a ROM in the CPU addressed by the programmed ROM for matching time intervals. When a match is found the CPU outputs a projectile identifying signal specifying the description of the projectile as shown in FIG. 3*b* for display on display 11 which is preferably a LCD display.

Previous to identifying the projectile the CPU received a logic high ST signal from one of the flip-flops 33–36 at one of the control ports. The program in the CPU monitors these ports and depending upon which port goes high identifies the particular target corresponding to that port for generating a target identifying signal and applying that signal to the display 11 for displaying a description of the target as shown in FIG. 3*a*. This display occurs first followed by the display of FIG. 3*b*. However, these displays could be provided simultaneously if desired. Hold circuits (not shown) could hold the identifying signals for any time period desired until a new identifying signal is generated.

Because the target material is uniform throughout, it is capable of receiving multiple successive hits reliably throughout the target. What is important is that small projectiles can be distinguished from large projectiles to more accurately ascertain the actual damage that might occur to a real target as compared to a simulated target. Practical prior art hit recorder systems do not adequately distinguish projectiles accordingly and therefore it was difficult to immediately determine if the hit was of a type that would seriously damage an actual equivalent target, such as a tank. The present invention thus provides enhanced target hit evaluation, and an improved training environment.

The types of projectiles described herein are by way of example only. While a particular embodiment is described for generating a target and projectile identifying signal, other means for implementing the present invention will occur to those of ordinary skill in logic design art for measuring, recording and indicating the differences in projectiles and targets hit based on different time duration signals. For example, using a CPU with a twelve bit data input port, the multiplexer may be omitted and the twelve bits read simultaneously. Also other CPUs may operate differently, and thus require different kinds of enabling signals in order to generate the desired identifying signals. Therefore, the particular means of implementing the present invention is merely exemplary.

What is claimed is:

1. A projectile and target identifying apparatus comprising:

a target comprising two electrically conductive layers secured in electrically isolated spaced relation, said target having negligible effect on the velocity of a penetrating projectile, said spaced relation being such that projectiles of different types having given different lengths penetrating said target at the same given velocity are in concurrent ohmic contact with said conductive layers in corresponding time intervals of different durations, each time interval having a duration proportional to the length of the corresponding projectile type;

projectile signal generating means responsive to penetration of said target by any one of said projectiles of different types making simultaneous ohmic contact with both said conductive layers for generating a projectile signal manifesting only the time duration of the corresponding projectile type in said simultaneous contact; and identifying means responsive to said projectile signal for generating a projectile identifying signal representing the corresponding penetrating projectile type.

2. The apparatus of claim 1 including a plurality of targets, said apparatus including target signal generating means responsive to the penetration of a target by a projectile for generating a target signal manifesting that target penetrated, said identifying means including means responsive to the target signal for generating a target identifying signal.

3. The apparatus of claim 2 further including display means responsive to said identifying signal for graphically identifying said penetrating projectile type and said penetrated target.

4. The apparatus of claim 3 wherein said display means includes one of a liquid crystal display and raster scan video display.

5. The apparatus of claim 1 wherein said projectile signal generator means comprises count means for generating a count signal manifesting said time duration of ohmic contact of said penetrating projectile, said identifying means including signal processing means responsive to said count signal for generating a display signal identifying said corresponding projectile type.

6. The apparatus of claim 5 including a plurality of targets and target signal generator means for generating a target signal manifesting the target penetrated by a projectile, said signal processing means including a signal processor, said target signal generating means having enable and reset states for enabling said processor in the enable state to identify the penetrated target, said processor for counting the count of said count signal when enabled and for resetting the counting means and the enable means after completing said counting.

7. The apparatus of claim 6 wherein said processor includes memory means for storing standard time intervals for each said projectiles of different types and comparison means for comparing the time duration of a penetrating projectile to said stored standard time intervals.

8. The apparatus of claim 2 wherein said plurality of targets each manifest a different portion of a given target shape, said identifying means generating a display signal manifesting said identified projectile and the identified one of said plurality of targets.

9. The apparatus of claim 5 including cable means for coupling said count means at a remote location from said target, said cable means including amplifier means including inverting means for generating and transmitting logic high and low signals manifesting penetration of said target by said projectile and remotely located comparison means for comparing said high and low signals for producing a penetration signal manifesting penetration of a target by a projectile.

10. The apparatus of claim 9 wherein said count means includes a counter having an n bit output, said processor means including a central processor unit (CPU) having an m bit data input port for receiving a count signal where m is less than n, said processor means including multiplex means for converting said n bit count signal to sequentially occurring data signals having at most m bits manifesting said count applied to said data input port.

11. The apparatus of claim 10 wherein said target signal generating means includes latch means coupled to said projectile signal generating means for generating a latch signal for enabling said CPU to read said data signals at said data input port subsequent to the generation of said projectile signal, said CPU when enabled causing said multiplex means to sequentially output said at most m bits signals.

12. A projectile and target identifying apparatus comprising:

at least one target comprising electrical insulation means and two electrically conductive layers secured to the insulation means in spaced electrically isolated relation, said spaced relation being such that projectiles of given different lengths penetrating said at least one target at the same given velocity are in ohmic contact with said conductive layers of said at least one target in corresponding time intervals of different durations manifesting the length of the corresponding projectile;

circuit means including count means responsive to penetration of said at least one target by any one of said projectiles making simultaneous ohmic contact with both said conductive layers for generating a count signal manifesting the corresponding projectile length in said simultaneous contact; and signal processing means responsive to said count signal for generating a target and a projectile identifying signal for identifying the corresponding penetrating projectile based only on the time duration manifested by the corresponding count signal and for identifying that target of said at least one target penetrated by that projectile.

13. The apparatus of claim 12 wherein said circuit means includes cable means comprising amplifier and comparator means for generating a logic signal manifesting the presence of said any one penetrating projectile in accordance with the logic value of said logic signal, count means for counting clock pulses occurring during the duration that said any one projectile is in said ohmic contact with said conductive layers and latch means responsive to the value of said logic signal applied thereto for generating a latch signal manifesting the identity of a target.

14. The apparatus of claim 13 wherein said counter generates an n bit count signal, said signal processing means includes a central processor unit (CPU) and multiplex means, said multiplex means for converting said n bit count signal to m bits where m is less than n and wherein said CPU has a data input port of a maximum of m bits for generating said projectile identifying signal in response to said received m bit count signal.

15. The apparatus of claim 14 wherein said CPU includes table means for storing values corresponding to different projectile lengths, said CPU including means for addressing the table means in response to said received count signal for comparing the length manifested by said count signal to the stored values for generating a projectile identifying signal in accordance with which stored signal matches said received count signal.

16. The apparatus of claim 15 wherein the circuit means includes target signal generating means for generating a signal manifesting a hit target in response to a projectile penetrating said at least one target and for applying the target signal to said CPU, said CPU including means responsive to said applied target signal for generating a output signal manifesting the identity of said target penetrated by said projectile.

17. A projectile identifying apparatus for identifying different types of projectiles according to their lengths, each type having a different length, said apparatus comprising:

a pair of electrically conductive planar layers in spaced electrical isolation arranged parallel to each other a given distance smaller than the shortest of said lengths;

circuit means responsive to the electrical conductive connection of said layers for generating a signal manifesting the time duration a projectile penetrating said layers is ohmically engaged with said layers; and means responsive to said signal for identifying the type of projectile penetrating said layers in accordance with said time duration.

18. The apparatus of claim 17 wherein said circuit means includes means for generating a signal manifesting the time duration of said penetrating projectile in response to said electrically conductive connection, and count means responsive to said latter signal for generating a count signal manifesting said time duration.

19. The apparatus of claim 18 wherein said means for identifying includes computer processing means responsive to said count signal for generating a display signal manifesting the type of projectile penetrating said layers.

20. The apparatus of claim 19 including a plurality of targets, said means for generating a signal manifesting the time duration including means for generating a target identifying signal and for applying said target identifying signal to said computer processing means.

* * * * *